US006071173A

United States Patent [19]

Kelley

[11] Patent Number: 6,071,173

[45] Date of Patent: Jun. 6, 2000

[54] MINIATURE TOY VEHICLE MANUALLY URGED IN MOTION

[76] Inventor: William J. Kelley, 4471 Cross Creek Way, San Luis Obispo, Calif. 93401

[21] Appl. No.: 08/963,460

[22] Filed: Nov. 3, 1997

[51] Int. Cl.[7] ..... A63H 17/00

[52] U.S. Cl. ..... 446/465; 446/462; 446/431

[58] Field of Search ..... 446/431, 465, 446/471, 168, 462

[56] References Cited

U.S. PATENT DOCUMENTS

| | | | |
|---|---|---|---|
| 4,156,986 | 6/1979 | Kupperman et al. | 446/465 |
| 5,100,360 | 3/1992 | Entzel | 446/431 |
| 5,720,646 | 2/1998 | Shannon et al. | 446/431 |

FOREIGN PATENT DOCUMENTS

| | | | |
|---|---|---|---|
| 794261 | 2/1936 | France | 446/465 |
| 485351 | 1/1929 | Germany | 446/465 |
| 824162 | 6/1953 | Germany | 446/431 |
| 50470 | 9/1966 | Germany | 446/465 |
| 2012239 | 10/1971 | Germany | 446/431 |
| 1664348 | 7/1991 | U.S.S.R. | 446/465 |
| 669124 | 3/1952 | United Kingdom | 446/462 |

*Primary Examiner*—Robert A. Hafer
*Assistant Examiner*—Jeffrey D. Carlson
*Attorney, Agent, or Firm*—Myron Amer P.C.

[57] ABSTRACT

A miniature-sized toy vehicle that is set in motion with a push along an intended straight-ahead path of movement and which rides on a ball bearing in depending relation from the vehicle chassis, the revolving mode of which ball bearing contributes to an optimum length of travel, and wherein the vehicle chassis has a rotative degree of movement about the ball bearing and during its travel will realign itself, if inadvertently released at an angle to the movement path, into a proper position for travel along the intended straight-ahead path of movement, to further increase the length of travel of the toy vehicle.

1 Claim, 1 Drawing Sheet

MINIATURE TOY VEHICLE MANUALLY URGED IN MOTION

The present invention relates to improvements for a miniature-sized toy vehicle which is urged in movement by a push or manual thrust of the child user, in which the improvements result in significantly lengthening the length of travel of the toy vehicle and thus contribute to its play value.

BACKGROUND OF THE INVENTION

Field of the Invention

An effort to maximize the travel of a pushed toy vehicle is exemplified by U.S. Pat. No. 4,156,986 issued to Sam Kupperman et al. for "One-Piece Molded Plastic Vehicle and Transport Member" on Jun. 5, 1979. The '986 patented toy vehicle is constructed with a roller journalled for rotation on an axle that is mounted transversely of the vehicle, and thus also transversely of the intended straight-ahead path of movement of the toy vehicle, and the revolving of the roller is what propels the toy vehicle in its movement. The length of travel of the '986 toy vehicle is greater than a toy vehicle which rides on conventional two front wheels and two rear wheels, but it is not totally effective in achieving the desired end result, nor is it easily implemented by a child attempting to use the toy vehicle as instructed.

More particularly, if the push or manual thrust of the '986 toy vehicle is not in total alignment with the intended straight-ahead path of movement, but instead is slightly at an angular orientation, the roller will revolve in a plane perpendicular to its axle and, because of the angular orientation of the axle, the toy vehicle will also skid or slide on the surface of the revolving roller. The sliding component of the '986 toy vehicle movement lessens its length of travel.

SUMMARY OF THE INVENTION

In practice, it has been observed that children lack the dexterity and coordination to start in motion a toy vehicle that is exactly in alignment to an intended straight-ahead path of movement.

Broadly, it is an object to provide a push-propelled miniature-sized toy vehicle overcoming the foregoing and other shortcomings of the prior art.

BRIEF DESCRIPTION OF THE DRAWINGS

More particularly, it is an object to obviate the use of an axle-supported roller and instead use a vehicle-propelling component which not only has a revolving mode to propel the vehicle along a movement path, but also provides a rotative degree of movement to the vehicle chassis during its movement so that, while partaking of the rotative movement, the vehicle chassis is able to realign itself with the intended path of movement, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

DETAILED DESCRIPTION OF THE INVENTION

Figure 2:
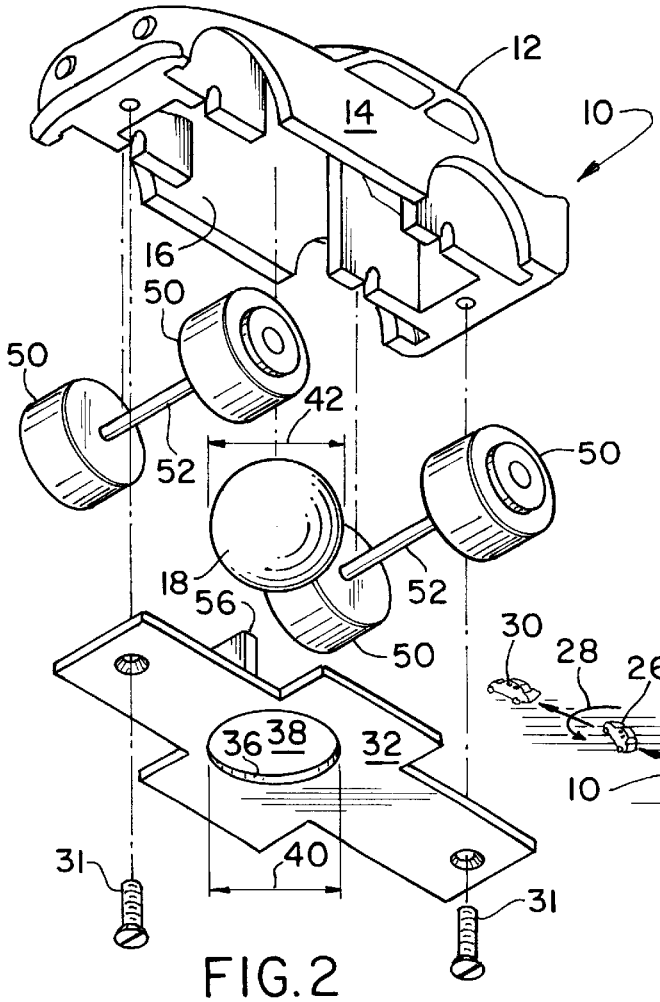
FIG. 2 is an exploded perspective view of the toy vehicle.
Figure 1:
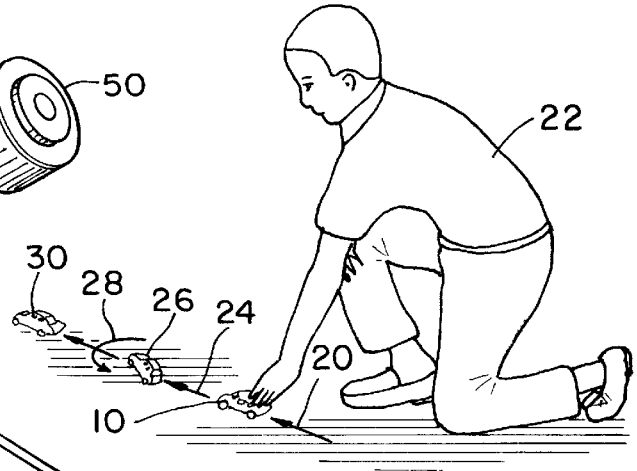
FIG. 1 is a perspective view illustrating a typical use of the within inventive miniature-sized toy vehicle.
Figure 3:
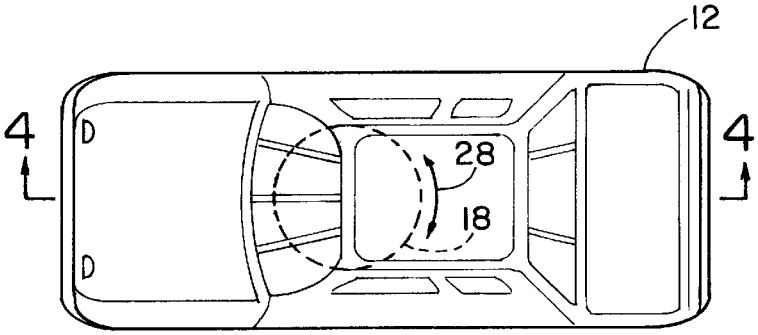
FIG. 3 is a plan view thereof.
Figure 5:
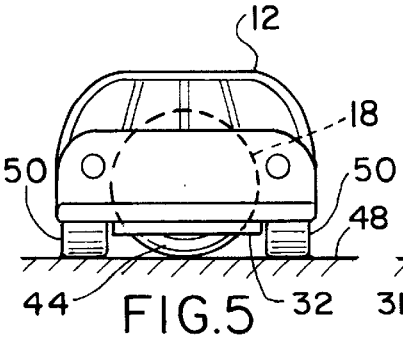
FIG. 5 is a front view of the within inventive toy vehicle.
Figure 4:
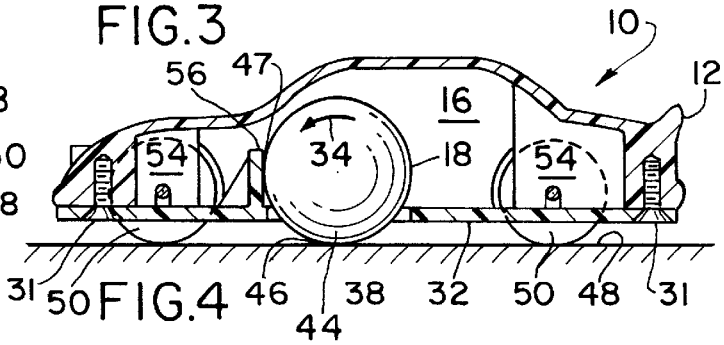
FIG. 4 is a sectional view, as taken along line 4—4 of FIG. 3.

Shown in the drawings in a preferred width of 5/16", length of 1 1/16", and height of 3/16", is a miniature-sized toy vehicle, generally designated 10, having a chassis 12 consisting of a wall 14 whose exterior surface simulates the appearance of a full-sized vehicle and an internal surface which bounds a compartment 16 for the positioning of a ball bearing 18 which has an operating mode of urging the toy vehicle 10, in response to a manual push or thrust 20 of a user 22, in a straight-ahead path of movement 24, the length of which, if of a maximum extent, contributes to the play value of the toy vehicle 10. In accordance with the present invention, it has been found in practice that the within inventive toy vehicle 10 exhibits a noteworthy length of travel because unavoidably as a result of an improper release during the manual thrust 20 the toy vehicle 10 may be angularly oriented to the intended straight-ahead path 24, as noted at 26, but undergoes a circular movement 28 about the ball bearing or spherical ball 18 which then orients the toy vehicle 10 back on alignment with the straight-ahead path 24, as noted at 30.

Appropriately attached, as by screws 31 or the like, as a closure for the ball-bearing positioning compartment 16 is an aptly referred-to ball-bearing means in the specific form of a plate 32 which contributes to the low-friction revolving 34 of the spherical ball 18 and, which plate 32 to this end has a circular centrally located wall 36 which bounds a ball bearing opening 38 of a selected diameter 40 which is slightly undersized with respect to the diameter 42 of the spherical ball 18 so that, as best understood from FIGS, 2 and 4, the weight of the ball 18 is effective to provide a ball lower portion 44 which establishes contact as at 46, with a riding surface 48, and provides rotating clearance for the ball 18 in the opening 38 because of the size differences of the diameters 40 and 42.

The chassis 12 is held in a horizontal position relative to the riding surface 48 by four simulated vehicle wheels 50 at opposite ends of axles 52 appropriately attached to internal walls 54 depending from the chassis 12, but otherwise the wheels 50 are not functional in contributing to the length of travel of the toy vehicle 10. What is functional to the length of travel of the toy vehicle 10 is the ball 18 in a revolving mode 34 in contact, as at 47, with a pushing wall 56 integral to the plate 32.

In addition to a contribution to the play value of the toy vehicle 10, due to an optimum maximum length along a straight-ahead path 24, the user with an intended thrust 20 can cause movement in the toy vehicle 10 simulating a skid, and can observe the circular movement 28 of the chassis 12 about the then vertical axis of the ball 18 which adjusts for the skid and returns the toy vehicle 10 back to an orientation in line with the straight-ahead path of movement 24.

While the toy vehicle herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for a miniature-sized toy vehicle of a type having a rectangular chassis, four wheels for display only each of which is mounted adjacent a corner of said chassis, and wherein said toy vehicle is adapted in use to be urged by a manual push in motion along a straight-ahead path of movement, said improvements comprising a ball bearing-mounting plate having a centrally located circular wall bounding a ball bearing-mounting opening, a spherical ball bearing revolvably seated in said ball bearing-mounting opening with a spherical portion thereof projected through said ball bearing-mounting opening and in depending relation from said ball bearing-mounting plate so as to contact a riding surface for said toy vehicle, a chassis with wall means bounding a centrally-located ball bearing-positioning compartment positioned above said ball bearing-mounting opening, said spherical ball bearing disposed in said ball bearing-position compartment with a selected diameter of said ball bearing effective to provide a depending surface thereof projected through said ball bearing-mounting opening and into contact with a riding surface and effective to hold said display four wheels in slight clearance positions with only nominal contact with said riding surface, and means attaching said ball bearing-mounting plate with said ball bearing seated in said ball bearing-mounting opening thereof to said chassis so that said chassis has a circular degree of movement relative to said seated ball bearing, whereby in response to a manual push said toy vehicle is transported on said revolving ball bearing in a straight ahead path of movement and said chassis undergoes a circular movement adjusting said chassis from an angular orientation to an orientation in alignment with said straight ahead path of movement to contribute to a length of travel of said toy vehicle along said path of movement.

* * * * *